US009175914B1

(12) United States Patent
Bird et al.

(10) Patent No.: US 9,175,914 B1
(45) Date of Patent: Nov. 3, 2015

(54) REMOTE WEAPONS CHARGING HANDLE ADAPTER

(71) Applicants: James Bird, Succasunna, NJ (US); James Giacchi, Warren, NJ (US); Russell Jones, III, Newton, NJ (US); Matthew Moeller, Randolph, NJ (US); David Bound, Rockaway, NJ (US)

(72) Inventors: James Bird, Succasunna, NJ (US); James Giacchi, Warren, NJ (US); Russell Jones, III, Newton, NJ (US); Matthew Moeller, Randolph, NJ (US); David Bound, Rockaway, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/492,533

(22) Filed: Sep. 22, 2014

(51) Int. Cl.
*F41F 1/08* (2006.01)
*F41A 3/72* (2006.01)

(52) U.S. Cl.
CPC ..... *F41A 3/72* (2013.01)

(58) Field of Classification Search
USPC ..... 89/1.4, 132, 154
See application file for complete search history.

(56) References Cited

U.S. PATENT DOCUMENTS

| | | | | | |
|---|---|---|---|---|---|
| 2,413,112 | A * | 12/1946 | Pontius et al. | ..... | 89/1.4 |
| 2,590,153 | A * | 3/1952 | Bunnell | ..... | 89/1.4 |
| 4,974,499 | A * | 12/1990 | Sanderson et al. | ..... | 89/1.4 |
| 8,297,164 | B1 * | 10/2012 | Mensch | ..... | 89/1.4 |
| 8,297,167 | B2 * | 10/2012 | Hoffman | ..... | 89/11 |
| 2005/0262992 | A1 * | 12/2005 | Becker | ..... | 89/1.4 |

* cited by examiner

*Primary Examiner* — J. Woodrow Eldred
(74) *Attorney, Agent, or Firm* — Henry S. Goldfine

(57) ABSTRACT

A remotely-operated gun is mounted in a cradle having a linear actuator for charging the gun. A charging adapter that is fixed to the linear actuator enables different types of guns to be charged. The charging adapter is easily configured to accommodate different gun types.

20 Claims, 12 Drawing Sheets

REMOTE WEAPONS CHARGING HANDLE ADAPTER

STATEMENT OF GOVERNMENT INTEREST

The inventions described herein may be manufactured, used and licensed by or for the United States Government.

BACKGROUND OF THE INVENTION

The invention relates in general to remotely-operated weapons and in particular to charging mechanisms for remotely-operated guns.

Remotely-operated weapons may include a turret mounted on a vehicle, or on a fixed or mobile carriage. The turret may include a frame for supporting a firearm. The firearm used in a remotely-operated weapon may be a conventional, human-operated firearm. The firearm may be designed to be cycled manually or automatically, for example, by propellant gas or by gun recoil. The frame on which the weapon is mounted may accept multiple, different weapon configurations. An example of a remotely-operated weapon system is the U.S. military's Common Remotely Operated Weapon Station (CROWS).

For a remotely-operated gun, a linear actuator may provide the input for the charging handle to move the weapon's bolt to the rear, to enable feeding ammunition. After locking the bolt rearward, the charging handle must then be returned forward to prevent weapon damage. The M240 Machine Gun, Mark 48 (Mk 48) Machine gun, and M249 Machine Gun are gas-operated automatic weapons which require charging (moving the charging handle rearward and then forward) to load and clear the weapon. When used on remote weapon stations, the linear actuator typically provides the external input required to actuate these weapons. The linear actuator moves the weapon's bolt assembly to the rear position to cycle and feed the next round on the belt. On the linear actuator return stroke, the charging handle is moved forward to the forward detent position.

While different remotely-operated weapons may use the same mounting cradle (for example, the CROWS Multi Adapter Small Caliber (MASC) cradle), these weapons often require different charging handle adapters because of different charging handle sizes and positions on the different weapons. The various adaptors are easily lost and do not allow for reliable return of the charging handle to the forward position.

A need exists for a simple apparatus and method for interfacing with different weapon charging handle configurations on a single gun cradle.

SUMMARY OF INVENTION

One aspect of the invention is remote weapons charging handle adapter for charging a gun having a forward and a rear end. The gun is mounted in a cradle having a linear actuator.

The adapter includes a flange portion fixed to the linear actuator and a housing fixed to the flange portion. The housing has an upper rear bearing surface, a pair of side surfaces, a forward surface, and a rear stepped surface. A wire rope has a first end selectively engageable with one of a hard stop on the flange and a hard stop on the housing. A second end of the wire rope extends into an upper portion of the housing through a first spring and a piston such that the second end of the wire rope is translatable against the spring in a rear direction.

An arm block has a rear curved bearing surface and a front planar surface that bears against the rear stepped surface of the housing. A rod is fixed eccentrically to the arm block and extends through the housing. A second spring is disposed around the rod and bears against the forward surface of the housing and a spring stop on an end of the rod to thereby bias the arm block in a forward direction.

In a first configuration of the adapter, the arm block extends transversely beyond one of the pair of side surfaces of the housing, and, in a second configuration of the adapter, the arm block extends transversely beyond the other of the pair of side surfaces of the housing.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel remote weapons charging handle adapter (RWCHA) can be used with several different remotely-operated guns. The gun is mounted in a cradle, for example, the CROWS Multi Adapter Small Caliber (MASC) cradle. The RWCHA can be used with, for example, the M240, Mk 48 and M249 machine guns, and various series models of each type of machine gun. The RWCHA mounts to the existing cradle.

Figure 5:
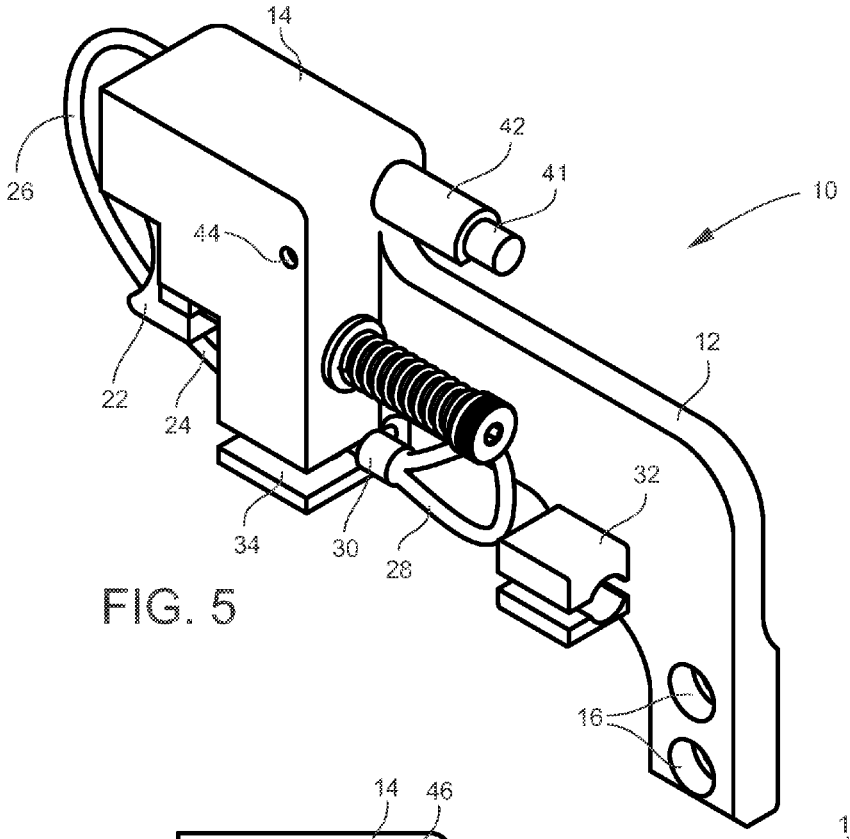
FIGS. 5 and 7 are perspective views of the adapter of FIG. 1 in a second configuration.
Figure 6:
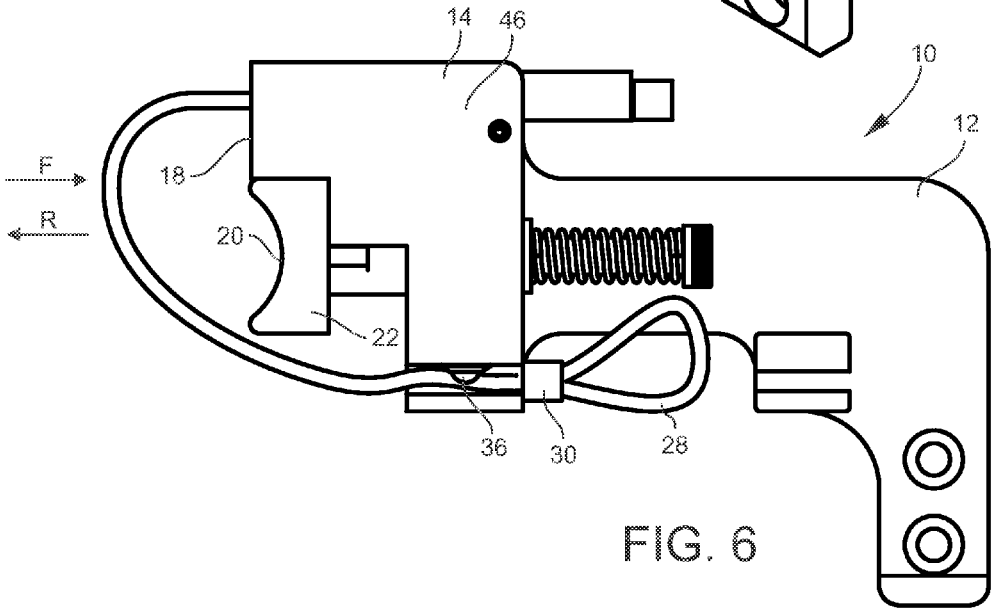
FIG. 6 is a side view of the adapter in the second configuration.
Figure 7:
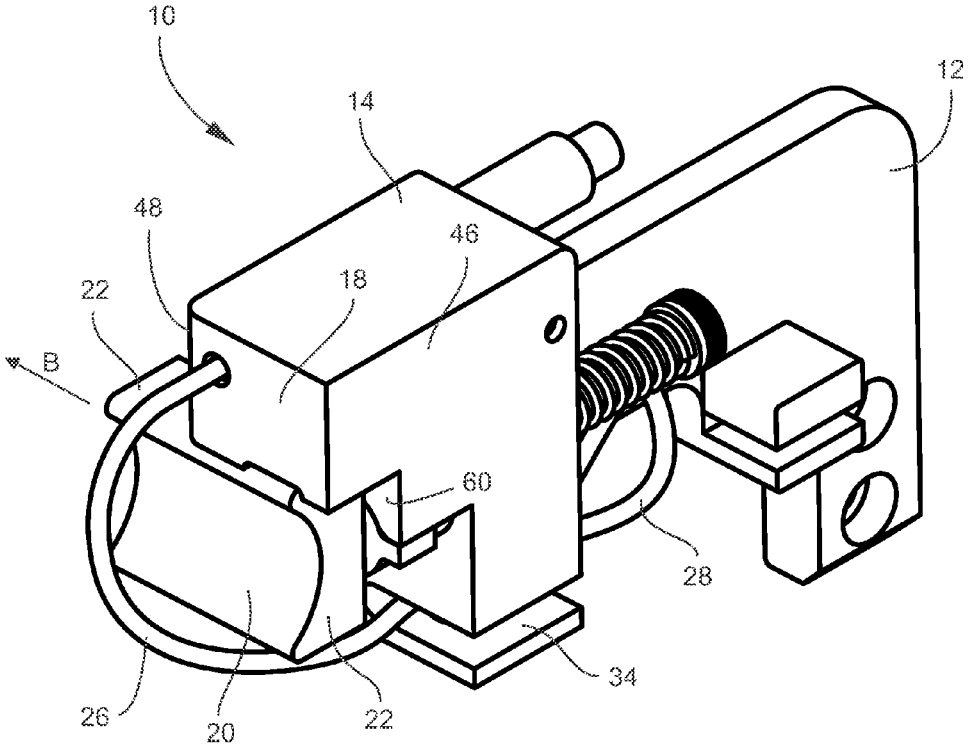

FIGS. 1-4 show one embodiment of an RWCHA or adapter 10 in a first configuration and FIG. 5-7 show adapter 10 in a second configuration. Referring to FIGS. 1-4, adapter 10 includes a generally L-shaped flange portion 12 fixed to a housing 14. Adapter 10 is mounted to the linear actuator of a weapon cradle using fasteners (not shown) inserted through mounting holes 16 in flange portion 12. The linear actuator of the mounting cradle causes adapter 10 to translate in the directions F (forward) and R (rear) shown by the arrows in FIG. 1.

Figure 1:
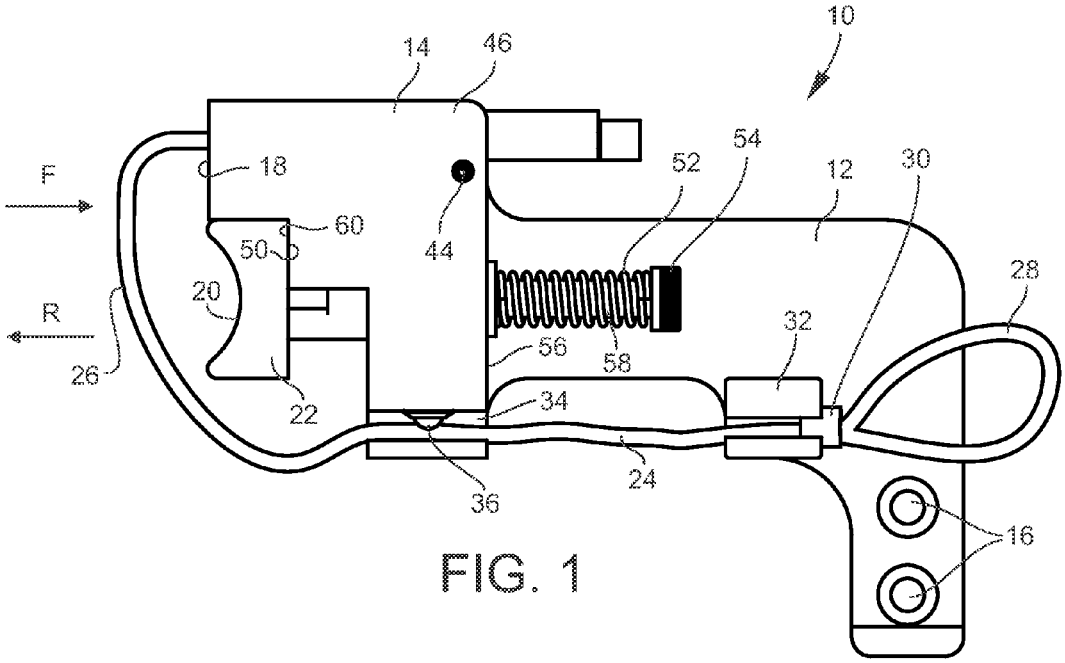
FIG. 1 is a side view of one embodiment of a remote weapons charging handle adapter in a first configuration.

In general, to move the charging handle or mechanism of the gun rearward in direction R, adapter 10 translates to the left in FIG. 1. Depending on the particular model or series of gun, adapter 10 pushes the charging handle or mechanism of the gun rearward using either bearing surface 18 or bearing surface 20. Bearing surface 18 is a rearward facing, planar surface of housing 14. Bearing surface 20 is a rearward facing curved surface formed in an arm block 22. The curved surface 20 is shaped to distribute load evenly on the cylindrical charging handles of guns.

In general, to move the charging handle or mechanism of the gun forward in direction F, adapter 10 translates to the right in FIG. 1. A loop portion 26 of a wire rope 24 engages the rearward surface of the weapon charging mechanism and the adapter 10 pulls the charging mechanism in the forward direction F. Some gun models may have an automatic return for the charging mechanism, in which case the adapter 10 is not required to positively move the charging mechanism forward.

One end of wire rope 24 includes a finger loop 28 formed by a compression sleeve 30. Sleeve 30 is constrained from translation in direction R by a stop 32 fixed to flange portion 12. In the second configuration of adapter 10 (FIGS. 5-7), sleeve 30 is constrained from rearward translation in direction R by a slot 34 at the bottom of housing 14 and by a spring detent 36 that constrains wire rope 24 from moving laterally out of slot 34. In the second configuration, there is, of course, more of the length of wire rope 24 available for loop portion 26.

Figure 2:
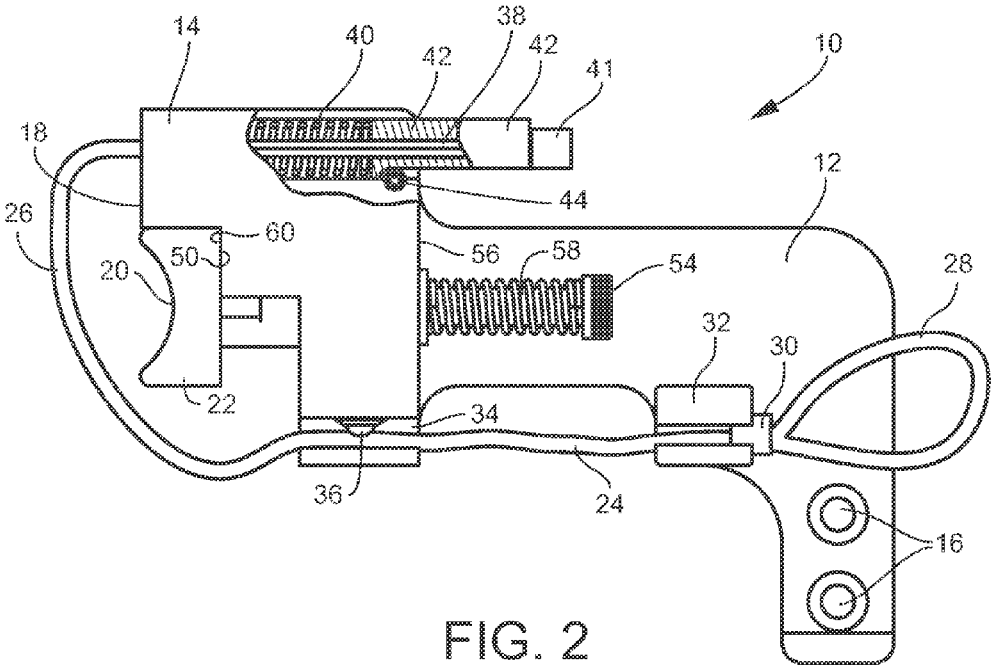
FIG. 2 is a partially cutaway view of the adapter of FIG. 1.

Referring to FIG. 2, the other end 38 of wire rope 24 passes through the rearward surface of housing 14, through a compression spring 40 and a piston 42, and is anchored with a fitting 41 against piston 42. Piston 42 may be made of, for example, a plastic material. Spring 40 provides some flexibility to the available length of wire rope 24 to allow for different charging handle locations and variation in interface tolerances. A roll pin 44 inserted through housing 14 restrains translation of piston 42 with respect to housing 14 in forward direction F.

Figure 3:
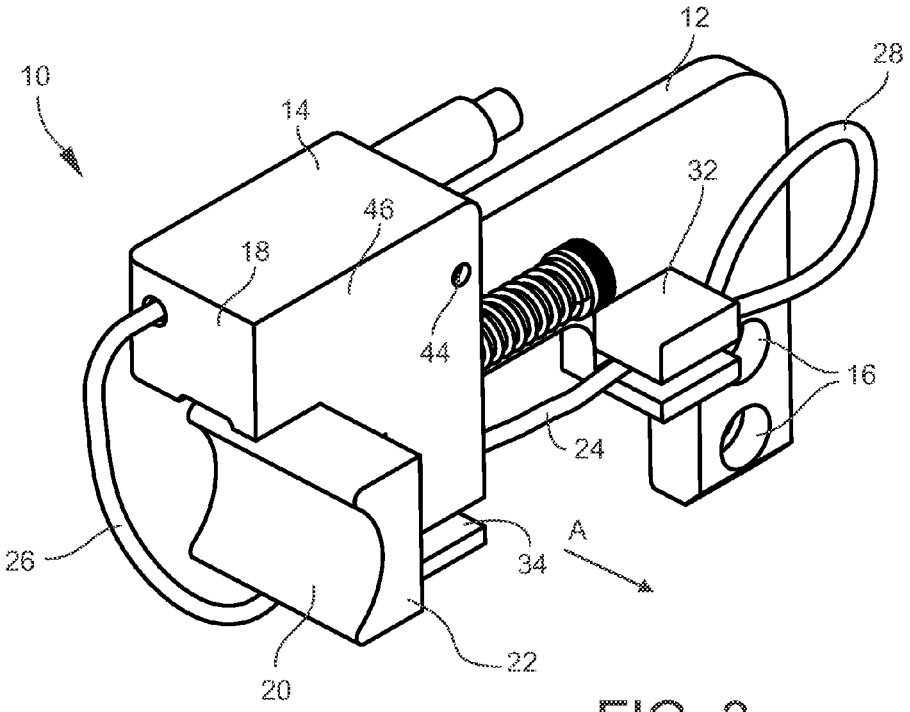
FIGS. 3 and 4 are perspective views of the adapter of FIG. 1.
Figure 4:
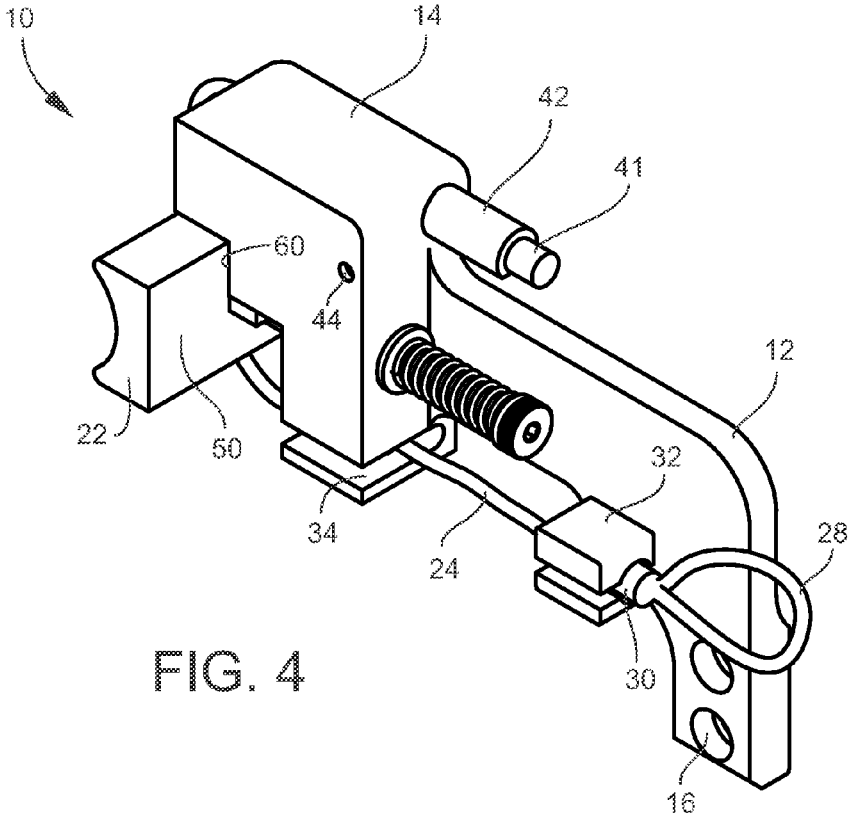

The position of arm block 22 in the first and second configurations is best seen by comparing FIG. 3 (first configuration) with FIG. 7 (second configuration). It is noted that wire rope 24 and arm block 22 are not mechanically connected. In FIG. 3 it is seen that arm block 22 extends outward in direction A beyond the side surface 46 of housing 14. On the other hand, in FIG. 7, it is seen that arm block 22 extends inward in direction B beyond the opposite side surface 48 of housing 14. The two positions of arm block 22 enable adapter 10 to interface with different gun configurations, as will be explained in more detail.

Referring to FIG. 1, arm block 22 includes rear curved bearing surface 20 and a front planar surface 50. Arm block 22 is biased against a rear facing stepped surface 60 of housing 14. Arm block 22 is biased against surface 60 in the forward direction F by a compression spring 52 that bears against a spring stop 54 and a front surface 56 of housing 14. Arm block 22 is fixed to a rod 58 that terminates at spring stop 54. Arm block 22 is fixed in an off center or eccentric manner to rod 58 so that arm block 22 extends beyond side surface 46 (first configuration, see FIG. 3) or side surface 48 (second configuration, see FIG. 7). The position of arm block 22 is easily changed by manually pulling arm block 22 in direction R beyond rear bearing surface 18 of housing 14. Then, arm block 22 is rotated 180 degrees and gently allowed to spring back so that front planar surface 50 is again abutting and biased against rear stepped surface 60 of housing 14.

Figure 8:
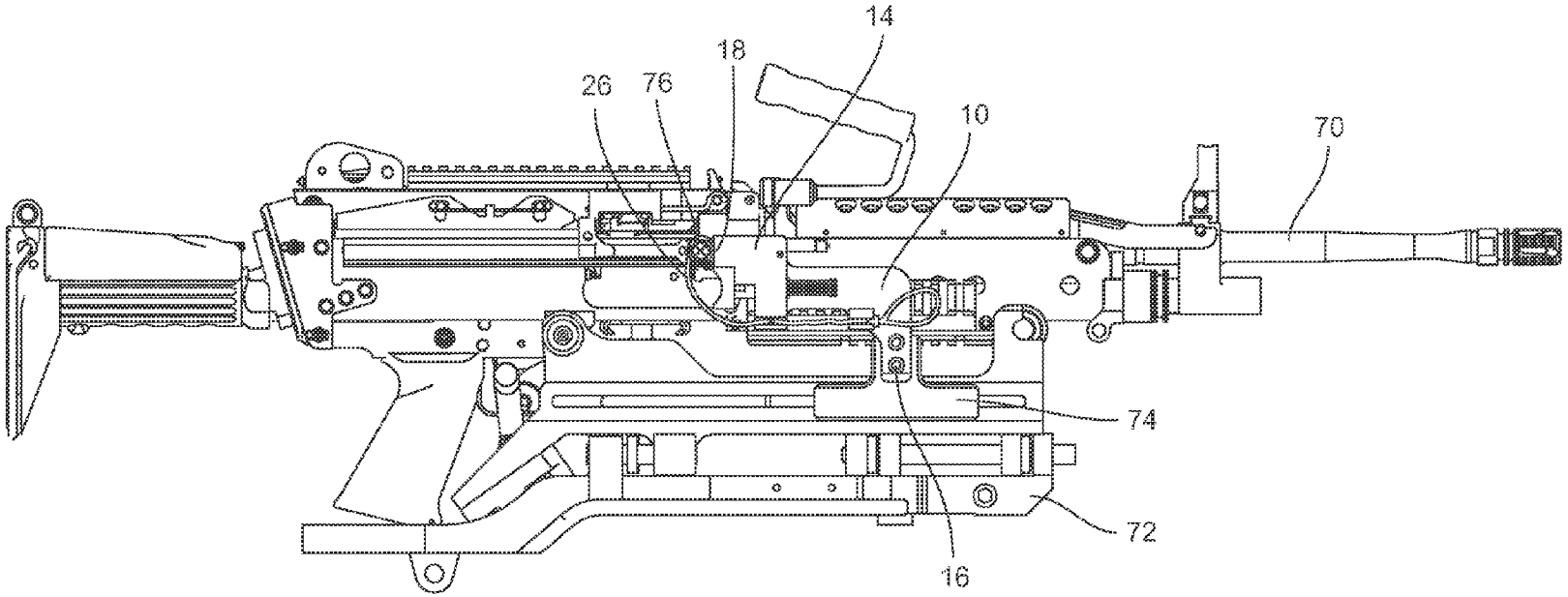
FIGS. 8 and 9 are side and perspective views, respectively, of a remote weapons charging handle adapter with an M249 machine gun.
Figure 9:
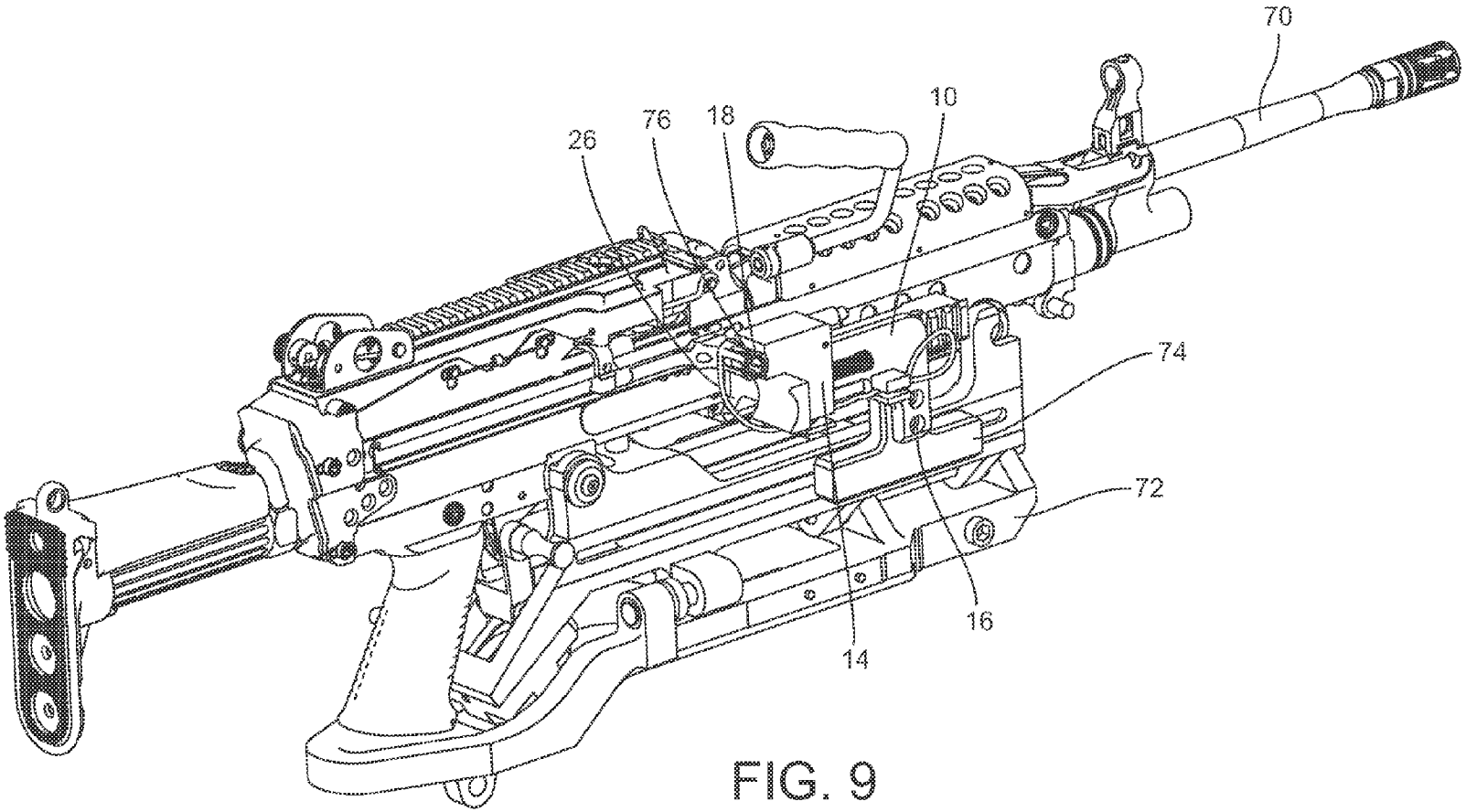

FIGS. 8 and 9 are side and perspective views, respectively, of adapter 10 with an M249 machine gun 70. Gun 70 is mounted on a cradle 72 having a linear actuator 74. Adapter 10 is mounted to actuator 74 with fasteners in mounting holes 16. In FIGS. 8 and 9, the first configuration (FIGS. 1-4) of adapter 10 is used. The charging handle 76 of gun 70 bears against bearing surface 18 on housing 14 and is contained in wire loop portion 26 of wire rope 24. In FIGS. 8 and 9, charging handle 76 is in its forward position.

Figure 10:
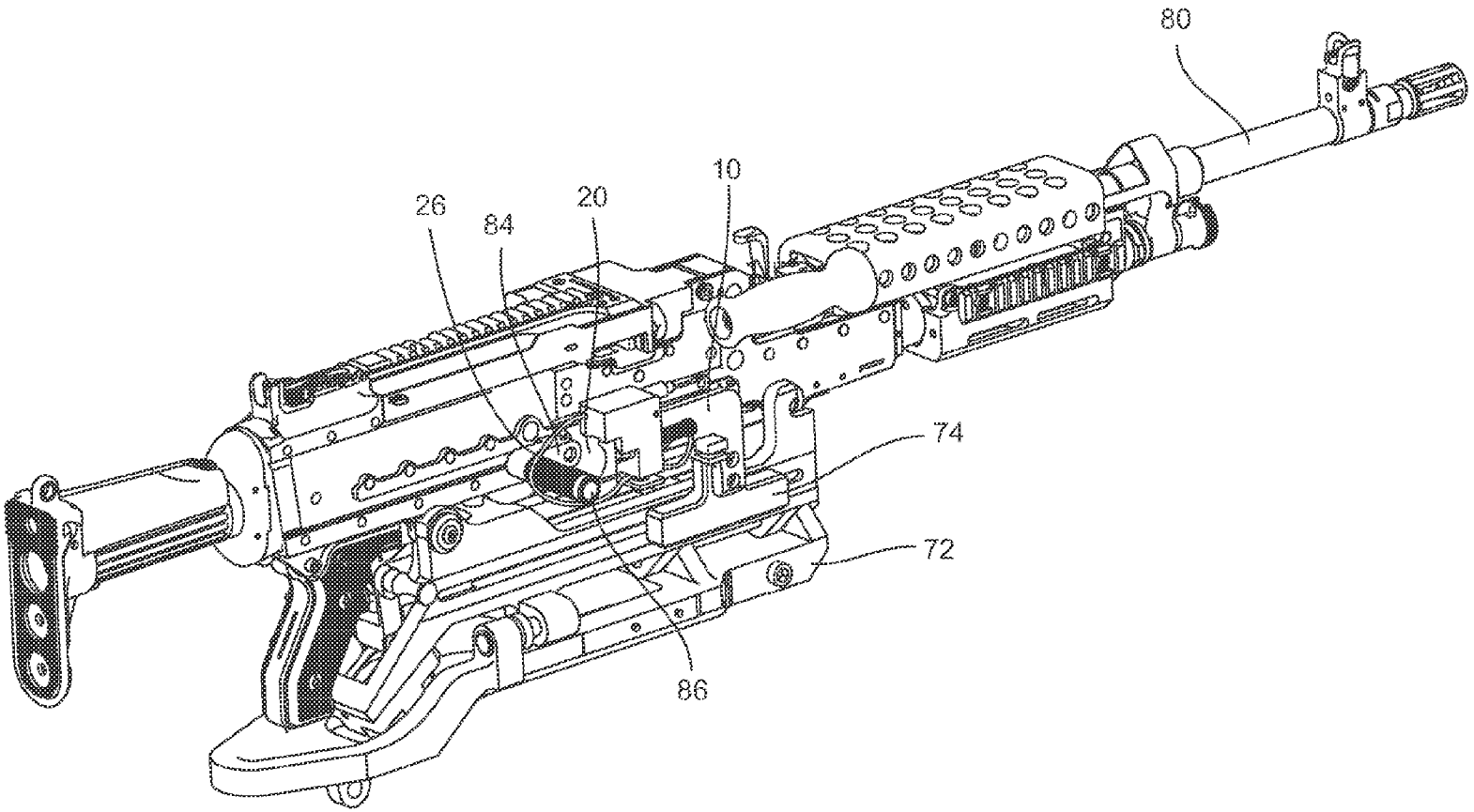
FIGS. 10 and 11 are perspective and side views, respectively, of a remote weapons charging handle adapter with an M240B machine gun.
Figure 11:
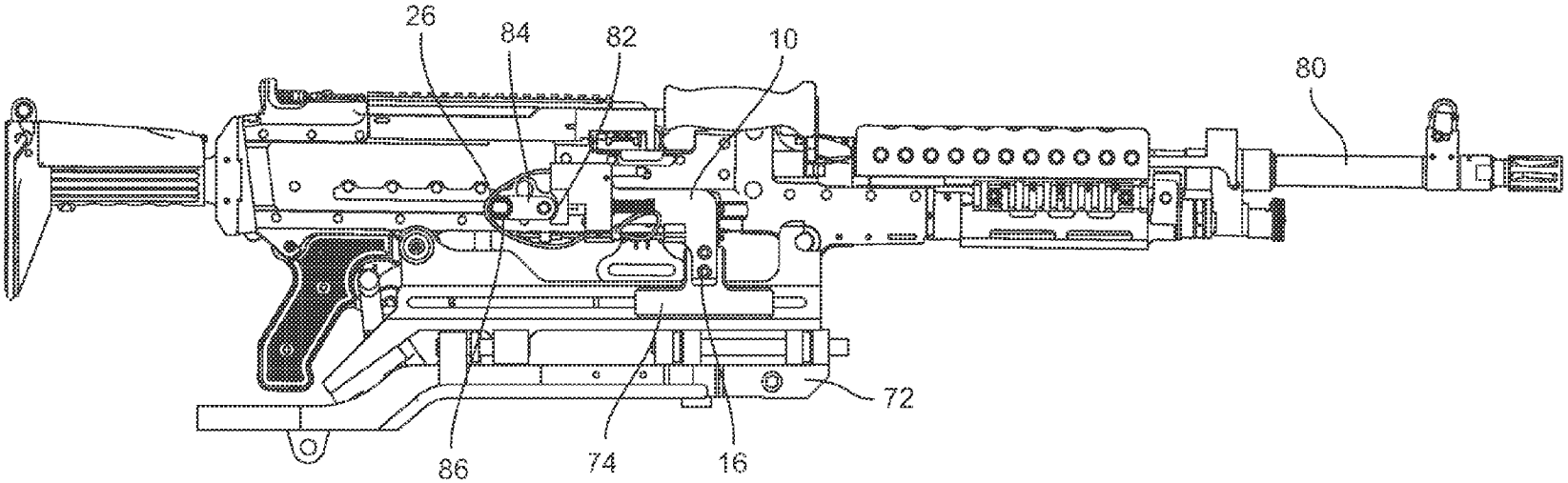

FIGS. 10 and 11 are perspective and side views, respectively, of adapter 10 with an M240B machine gun 80. Gun 80 is mounted on a cradle 72 having a linear actuator 74. Adapter 10 is mounted to actuator 74 with fasteners in mounting holes 16. In FIGS. 10 and 11, the second configuration (FIGS. 5-7) of adapter 10 is used. A forward curved surface 82 of a charging mechanism 84 of gun 80 bears against curved bearing surface 20 of arm block 22. A charging handle 86 of charging mechanism 84 is contained in wire loop portion 26 of wire rope 24. In FIGS. 10 and 11, charging mechanism 84 is in its forward position.

Figure 12:
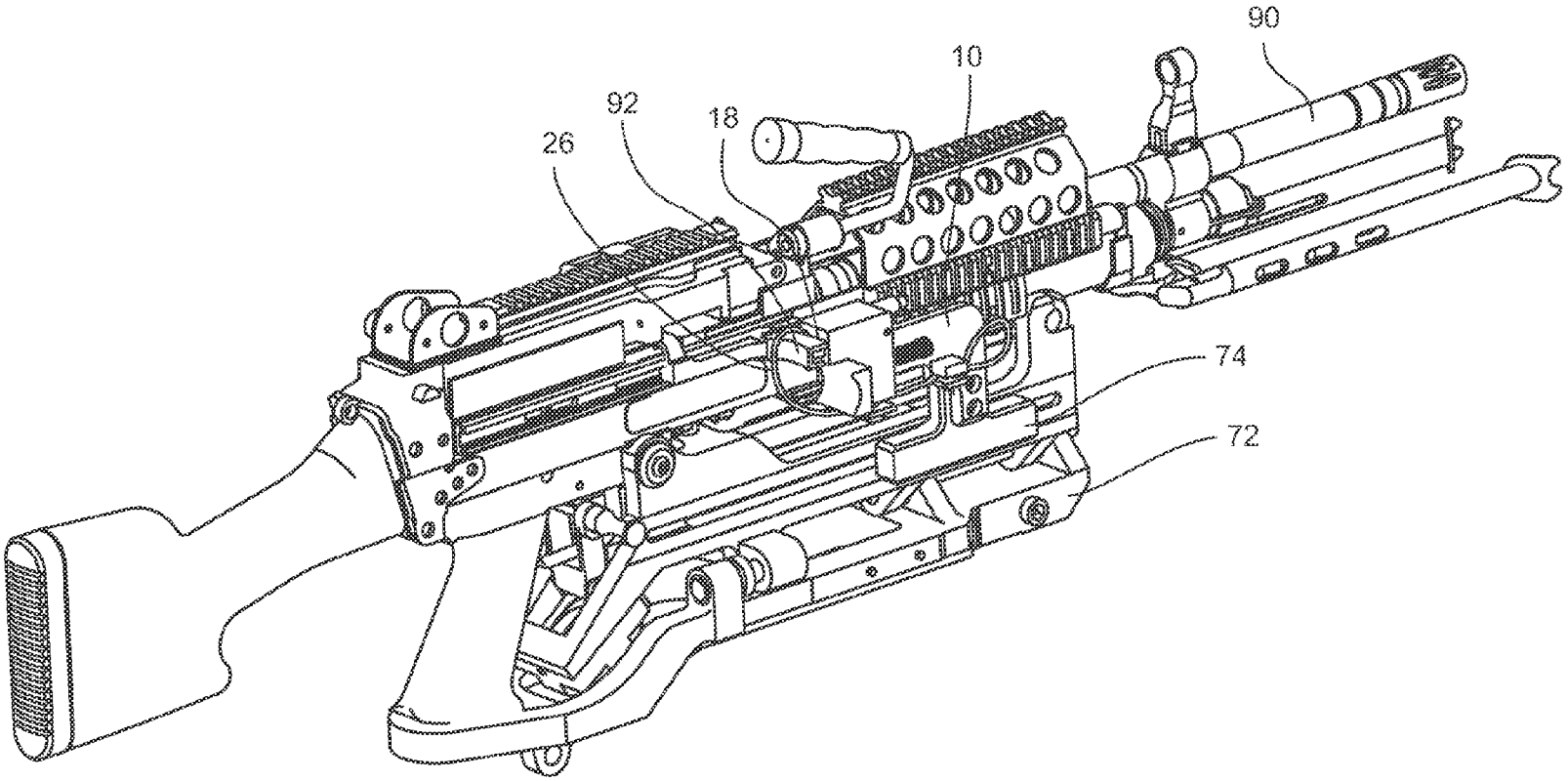
FIGS. 12 and 13 are perspective and side views, respectively, of a remote weapons charging handle adapter with an Mk48 machine gun.
Figure 13:
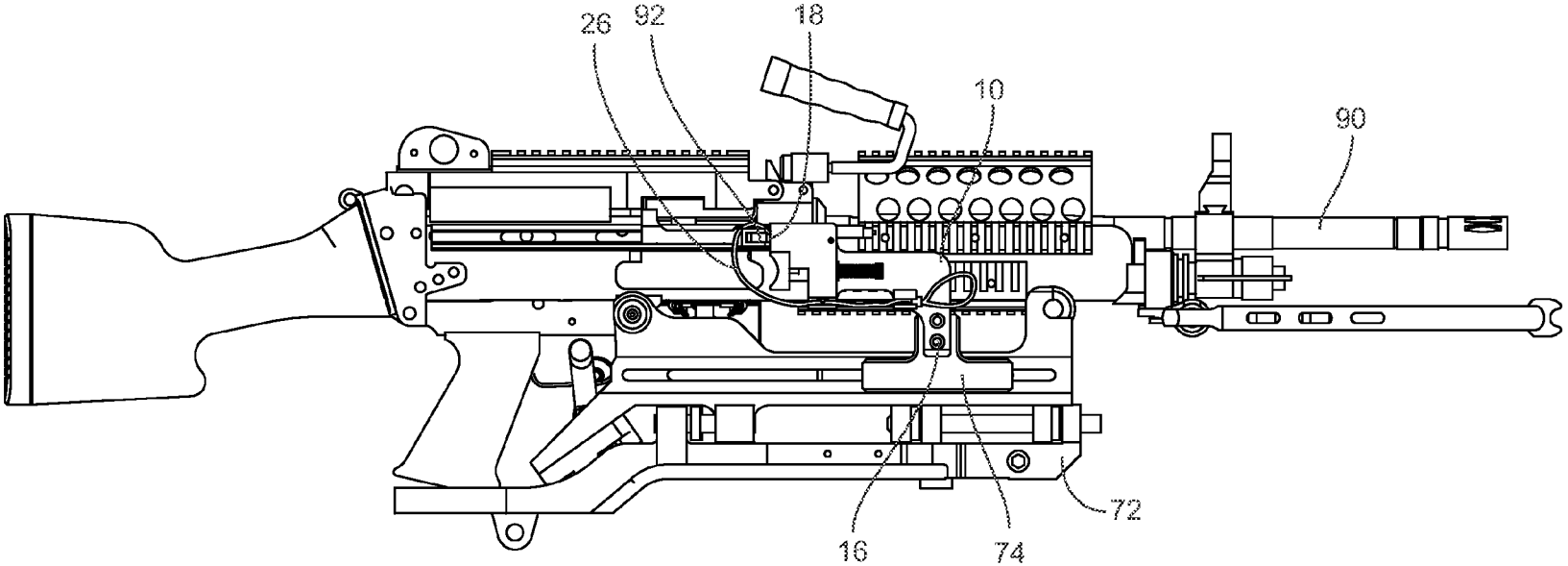

FIGS. 12 and 13 are perspective and side views, respectively, of adapter 10 with an Mk48 machine gun 90. Gun 90 is mounted on a cradle 72 having a linear actuator 74. Adapter 10 is mounted to actuator 74 with fasteners in mounting holes 16. In FIGS. 12 and 13, the first configuration (FIGS. 1-4) of adapter 10 is used. The charging handle 92 of gun 90 bears against bearing surface 18 on housing 14 and is contained in wire loop portion 26 of wire rope 24. In FIGS. 12 and 13, charging handle 92 is in its forward position.

Figure 14:
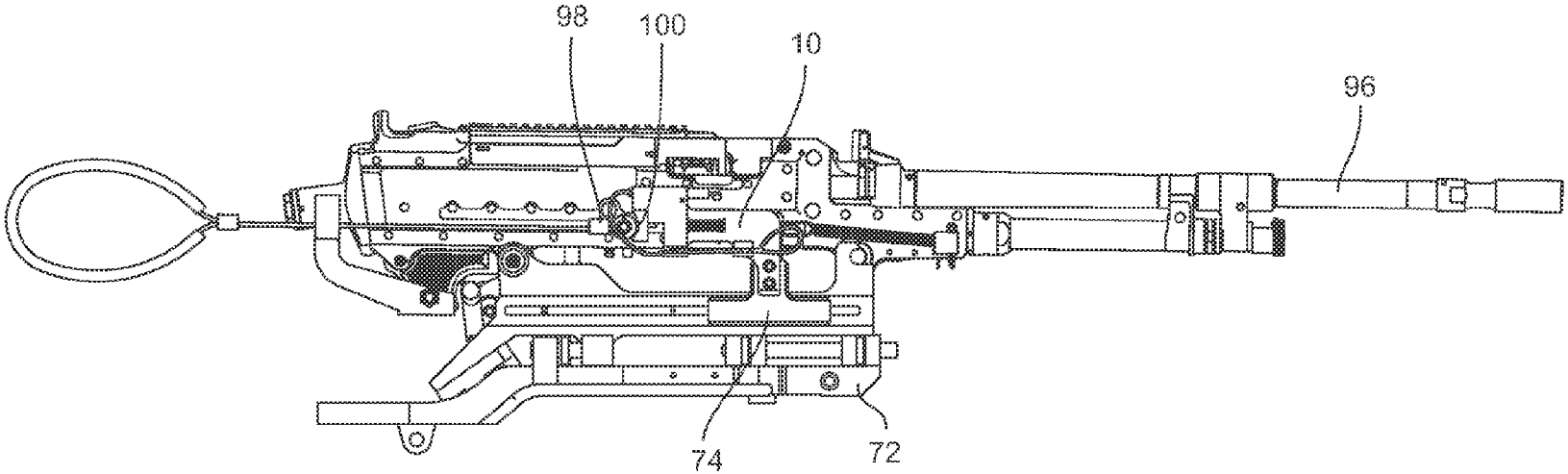
FIGS. 14 and 15 are side and perspective views, respectively, of a remote weapons charging handle adapter with an M240 machine gun.
Figure 15:
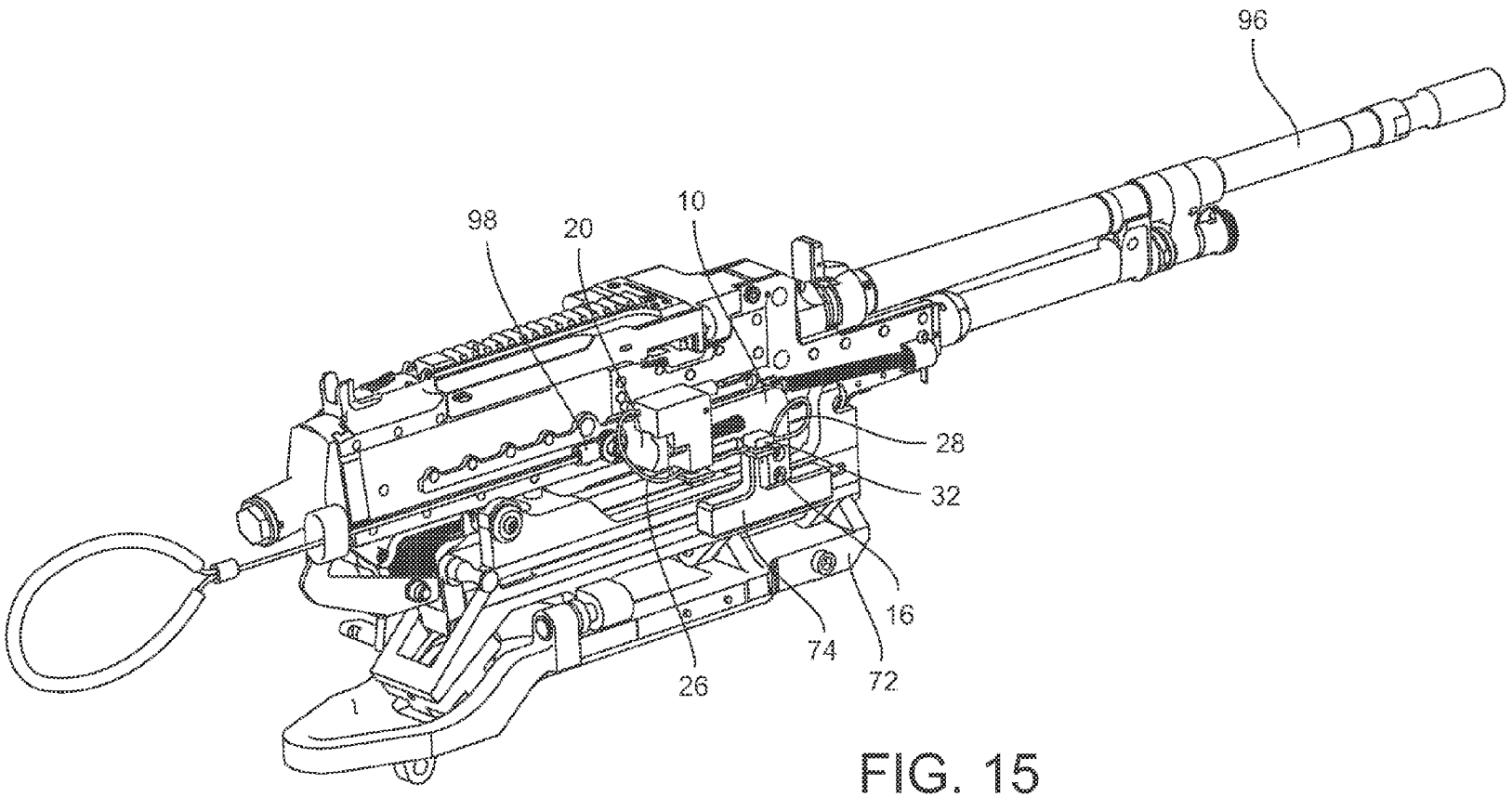

FIGS. 14 and 15 are side and perspective views, respectively, of adapter 10 with an M240 machine gun 96. Gun 96 is mounted on a cradle 72 having a linear actuator 74. Adapter 10 is mounted to actuator 74 with fasteners in mounting holes 16. In FIGS. 14 and 15, a variation of the second configuration (FIGS. 5-7) of adapter 10 is used. Rather than being secured against the slot 34 and spring detent 36, as in FIGS. 5-7, the compression sleeve 30 in FIGS. 14 and 15 is secured against the stop 32 on the flange portion 12. This is done to take slack out of the loop portion 26 of the wire rope 24 because the loop portion 26 is not needed, in as much as the M240 gun 96 has an automatic spring return for its charging mechanism 98. A curved surface 100 of charging mechanism 98 of gun 96 bears against curved bearing surface 20 of arm block 22. In FIGS. 14 and 15, charging mechanism 98 is in its forward position.

While the invention has been described with reference to certain embodiments, numerous changes, alterations and modifications to the described embodiments are possible without departing from the spirit and scope of the invention as defined in the appended claims, and equivalents thereof

What is claimed is:

1. A remote weapons charging handle adapter for charging a gun having a forward and a rear end, the gun being mounted in a cradle having a linear actuator, the adapter comprising:

a flange portion fixed to the linear actuator;

a housing fixed to the flange portion, the housing having an upper rear bearing surface, a pair of side surfaces, a forward surface, and a rear stepped surface;

a wire rope having a first end selectively engageable with one of a hard stop on the flange and a hard stop on the housing;

a second end of the wire rope extending into an upper portion of the housing through a first spring and a piston such that the second end of the wire rope is translatable against the spring in a rear direction;

an arm block having a rear curved bearing surface and a front planar surface that bears against the rear stepped surface of the housing;

a rod fixed eccentrically to the arm block and extending through the housing; and a second spring disposed around the rod and bearing against the forward surface of the housing and a spring stop on an end of the rod to thereby bias the arm block in a forward direction.

2. The adapter of claim 1, wherein, in a first configuration of the adapter, the arm block extends transversely beyond one of the pair of side surfaces of the housing, and, in a second configuration of the adapter, the arm block extends transversely beyond the other of the pair of side surfaces of the housing.

3. The adapter of claim 2, wherein an angular position of the arm block in the first configuration is 180 degrees from an angular position of the arm block in the second configuration.

4. The adapter of claim 2, wherein the first end of the wire rope includes a finger loop and a compressive sleeve.

5. The adapter of claim 2, wherein the hard stop on the housing includes a slot in a bottom of the housing.

6. The adapter of claim 5, further comprising a spring-loaded detent fixed to the slot to constrain transverse movement of the wire rope out of the slot.

7. The adapter of claim 2, wherein, in the first configuration, the first end of the wire rope engages the hard stop on the flange portion.

8. The adapter of claim 2, wherein, in the second configuration, the first end of the wire rope engages the hard stop on the housing.

9. The adapter of claim 2, wherein, in the second configuration, the first end of the wire rope engages the hard stop on the flange portion.

10. The adapter of claim 2, further comprising a pin inserted transversely through the upper portion of the housing to constrain translation of the piston in the forward direction.

11. An apparatus, comprising:

a gun cradle having a linear actuator; and the adapter of claim 1 fixed to the linear actuator.

12. The apparatus of claim 11, further comprising a machine gun mounted in the cradle.

13. The apparatus of claim 12, wherein the machine gun is an M240 machine gun.

14. The apparatus of claim 12, wherein the machine gun is a Mark 48 machine gun.

15. The apparatus of claim 12, wherein the machine gun is an M249 machine gun.

16. A remote weapons charging handle adapter for charging a gun having a forward and a rear end, the gun being mounted in a cradle having a linear actuator, the adapter comprising:

a flange portion fixed to the linear actuator;

a housing fixed to the flange portion, the housing having an upper rear bearing surface, a pair of side surfaces, a forward surface, and a rear stepped surface;

a wire rope having on one end a finger loop and a compression sleeve, the one end begin selectively engageable with one of a hard stop on the flange and a slot in a bottom of the housing;

a second end of the wire rope extending into an upper portion of the housing through a first spring and a piston such that the second end of the wire rope is translatable against the spring in a rear direction;

an arm block having a rear curved bearing surface and a front planar surface that bears against the rear stepped surface of the housing;

a rod fixed eccentrically to the arm block and extending through the housing; and a second spring disposed around the rod and bearing against the forward surface of the housing and a spring stop on an end of the rod to thereby bias the arm block in a forward direction;

wherein, in a first configuration of the adapter, the arm block extends transversely beyond one of the pair of side surfaces of the housing and, in a second configuration of the adapter, the arm block extends transversely beyond the other of the pair of side surfaces of the housing and further wherein an angular position of the arm block in the first configuration is 180 degrees from an angular position of the arm block in the second configuration.

17. The adapter of claim 16, further comprising a spring-loaded detent fixed to the slot to constrain transverse movement of the wire rope out of the slot.

18. The adapter of claim 16, wherein, in the first configuration, the one end of the wire rope engages the hard stop on the flange portion.

19. The adapter of claim 16, wherein, in the second configuration, the one end of the wire rope engages the slot in the housing.

20. The adapter of claim 16, wherein, in the second configuration, the one end of the wire rope engages the hard stop on the flange portion.

* * * * *